US005932338A

United States Patent [19]

Schnabele et al.

[11] Patent Number: 5,932,338

[45] Date of Patent: Aug. 3, 1999

[54] FILM FOR TAMPER-PROOF COVERINGS FOR PRODUCT CARRIERS

[75] Inventors: Jürgen Schnabele, Bernried; Norwin Schmidt, Neu-Ulm; Henning Lubemann, Memmingen, all of Germany; Anton Wolfsbanger; Jürgen Emig, both of Linz, Australia

[73] Assignees: BP Chemicals Plastec GmbH, Dietenheim, Germany; PCD Polymere Gesellschaft, Schwechat-Mannsworth, Austria

[21] Appl. No.: 08/416,713

[22] PCT Filed: Aug. 18, 1993

[86] PCT No.: PCT/EP93/02200

§ 371 Date: Nov. 22, 1995

§ 102(e) Date: Nov. 22, 1995

[87] PCT Pub. No.: WO94/10229

PCT Pub. Date: May 11, 1994

[30] Foreign Application Priority Data

Oct. 28, 1992 [DE] Germany ..... 42 36 450

[51] Int. Cl.[6] ..... B32B 5/16

[52] U.S. Cl. ..... 428/323; 428/34.1; 428/325; 428/327; 428/480; 428/515; 206/531; 206/532; 206/539; 53/173

[58] Field of Search ..... 206/461, 469, 206/538, 532, 807, 531, 539; 428/515, 323, 327, 325, 213, 480, 911, 34.1; 53/173

[56] References Cited

U.S. PATENT DOCUMENTS

| | | | |
|---|---|---|---|
| 3,835,995 | 9/1974 | Haines | 206/42 |
| 3,899,080 | 8/1975 | Brunda | 206/531 |
| 4,075,050 | 2/1978 | Takashi et al. | 156/229 |
| 4,780,364 | 10/1988 | Wade et al. | 428/315.5 |
| 4,869,938 | 9/1989 | Usami et al. | 428/34.3 |
| 5,011,019 | 4/1991 | Satoh et al. | 206/530 |
| 5,055,388 | 10/1991 | Vogt et al. | 435/4 |
| 5,145,737 | 9/1992 | Boiron et al. | 428/334 |
| 5,360,116 | 11/1994 | Schmiletzky | 206/531 |
| 5,484,631 | 1/1996 | Hoh | 428/2 |
| 5,522,506 | 6/1996 | Roulin et al. | 206/531 |
| 5,536,773 | 7/1996 | Yamada et al. | 524/499 |

FOREIGN PATENT DOCUMENTS

| | | |
|---|---|---|
| 0022664 | 1/1981 | European Pat. Off. . |
| 0277514 | 8/1988 | European Pat. Off. . |
| 0321843 | 6/1989 | European Pat. Off. . |
| 0353613 | 2/1990 | European Pat. Off. . |
| 0357841 | 3/1990 | European Pat. Off. . |
| 0398447 | 11/1990 | European Pat. Off. . |
| 0423402 | 4/1991 | European Pat. Off. . |
| 0454870 | 11/1991 | European Pat. Off. . |
| 0515825 | 12/1992 | European Pat. Off. . |
| 0613832 | 9/1994 | European Pat. Off. . |
| 3710670 | 3/1987 | Germany . |
| 87 08 367 | 8/1987 | Germany . |
| 91 03 973 | 8/1992 | Germany . |
| 4113714 | 10/1992 | Germany . |
| 4236450 | 5/1994 | Germany . |
| 49-033935 | 3/1974 | Japan . |
| 60-036128 | 2/1985 | Japan . |
| 61-133236 | 6/1986 | Japan . |
| 61-248793 | 11/1986 | Japan . |
| 61-258750 | 11/1986 | Japan . |
| 1079237 | 3/1989 | Japan . |
| 2301435 | 12/1990 | Japan . |
| 7041044 | 2/1995 | Japan . |
| 2195947 | 4/1988 | United Kingdom . |

OTHER PUBLICATIONS

ISO 7765–1: 1988(E); "Plastics Film and Sheeting—Determination of Impact Resistance by the Free–Falling Dart Method"; Dec. 15, 1988; pp. 1–7.

ISO 7765–2: 1994(E); Plastics Film and Sheeting—Determination of Impact Resistance by the Free–Falling Dart Method; Aug. 15, 1994; pp. 1–11.

*Primary Examiner*—Paul Thibodeau
*Assistant Examiner*—D. Lawrence Tarazano
*Attorney, Agent, or Firm*—Leydig, Voit & Mayer, Ltd.

[57] ABSTRACT

A film for tamper-proof coverings for product carriers consisting of platic is suggersted, which can replace the aluminum cover films known previously and which comprises a plastic matrix containing a particulate filler, this filler being selected and contained in the matrix with a proportion such that the penetration resistance of the film is reduced to below a limit of 450N/mm (measured on a film approximately 150 μm thick).

30 Claims, No Drawings

FILM FOR TAMPER-PROOF COVERINGS FOR PRODUCT CARRIERS

The invention relates to a film for tamper-proof coverings for product carriers, such as those known, for example, from a plurality of so-called blister packagings.

Such known films for blister coverings have so far consisted of aluminum films, plastic-coated aluminum films up to pure, transparent or opaque plastic films. These films form the counterpart to the product carrier or the so-called lower part of the package which can, again, be formed from a plurality of materials, for example from a stable cardboard layer, a plastic or aluminum tray adapted to the shape of the product or the like.

The problem so far with using plastic films as blister coverings was the fact that pressure-sensitive products, in particular, could not be pressed through the film and thus removed from the packaging without this leading to damage to the products, in particular in the case of tablets.

For this reason, when using films as cover portion for such packages either one resorted to aluminum foils, as is, in particular, the case for the packaging of pharmaceutical products, such as, e.g., tablets, ampoules or capsules, or a dispensing possibility was provided in the lower part of the package.

The object of the present invention is to provide a film for tamper-proof coverings for product carriers which can be produced from plastics and nevertheless displays the known push-through properties of aluminum foil coverings.

This object is accomplished in accordance with the invention, in the film described at the outset, in that the film is an undrawn film with a plastic matrix comprising polyolefins, polyester, polystyrene or styrene copolymers and contains a particulate filler in an amount of 20 to 60% by weight, wherein the filler has an average particle size (measured over the greatest extension of the particle) of approximately 5 $\mu$m to approximately 100 $\mu$m and is selected such that the penetration resistance of the film is reduced to below a limit of approximately 200N/mm (measured on a film 150 $\mu$m thick, measuring method according to German Industrial Standard DIN 53373).

This limit applies to films approximately 150 $\mu$m thick. For films which are considerably thinner or thicker, the corresponding limits can be derived from these values. With the specified limit it is possible to push products insensitive to pressure through the cover film of the product carrier, even if this entails some expenditure of force. With more sensitive articles, a lower limit will preferably be selected for the penetration resistance, and this value is then preferably at approximately 100 to approximately 200N/mm. Lower penetration resistances may be recommendable in individual cases where goods very sensitive to pressure are packed. However, in this respect it is to be noted that the protective effect of the packaging against damage to the goods themselves is, of course, decreased with the reduction in the penetration resistance and so the numerical range specified above of approximately 100 to approximately 200N/mm is in many cases to be seen as an optimum.

For the handling of the package by the consumer, i.e. in particular during opening of the package and, therefore, the product, a further property comes into secondary play, the so-called resistance to further tearing which determines the amount of force necessary to tear further open a film which has been pierced once and so release the product. This property can also be influenced by the choice of the filler as well as its proportion in the plastic matrix, whereby in this case a resistance to further tearing of less than 30N (measuring method according to DIN 53363) is aimed for. This numerical value applies in particular to films approximately 150 $\mu$m thick but can essentially also be used for considerably thinner or thicker films. A value for the resistance to further tearing which is acceptable for the handling, in particular, of pressure-sensitive goods, is between approximately 2 and 12N, whereby it is to be noted in this case as well that considerably smaller values are, of course, possible but with a view to the protection of the product by the film any arbitrary reduction is subject to limits. A preferred range for the resistance to further tearing is in the range of 3 to 4N.

The inventive film contains the filler as a homogeneous addition to a plastics material which is already completely polymerized. The filler is not, therefore,—as is known in conjunction with filler-reinforced plastics—dispersed in the polymerization reaction mixture of monomer and/or prepolymer and incorporated in the plastic matrix during curing of the reaction mixture. However, it is, of course, conceivable to use such a reinforced plastics material as plastic matrix in certain cases also in conjunction with the present invention.

A broad range of fillers is available for the fillers of the film. These can be selected from inorganic and/or organic substances.

Preferred embodiments for the organic substances are, e.g., halogenized hydrocarbon polymers, in particular PTFE, polyether sulfones which, like the PTFE, have a fixed point of >300° C., as well as thermoset plastics. In the case of the organic substances which are intended to serve as fillers, it is important that these do not liquefy during the processing of the plastic matrix material, during which temperatures of 220° C. and more can occur, and then form a homogeneous solution with the plastic matrix material but that they remain essentially in particle form in the plastic matrix during the processing and thus serve to weaken the continuous plastic matrix layer and, therefore, to reduce the penetration resistance accordingly and, where applicable, the resistance to further tearing.

For the inorganic component of the filler, the substance can be selected from the family of silicon dioxides, in particular in the form of glass or quartz, silicates, in particular in the form of talc, titanates, $TiO_2$, aluminum oxide, kaolin, calcium carbonates, in particular in the form of chalk, magnesites, MgO, iron oxides, silicon carbides, silicon nitrides, barium sulfate or the like.

When selecting the inorganic or organic substances as components of the filler, the article to be packed is always to be taken into consideration and its sensitivity to one or other of the additives in the polymer matrix.

The type of filler particles will most often be granular, but filler particles in the form of small plates, fibrous or rod-shaped particles are also possible as filler particles both as an essentially uniform type or also in a mixture with other types.

The choice of the particle size is, of course, also determined not inconsiderably by the thickness of the film layer to be produced. Care must therefore be taken that the average extension of the particles is kept at a clear distance from the thickness of the film to be produced. Average particle sizes between 20 $\mu$m and 60 $\mu$m are preferred, in particular with film thicknesses of 80$\mu$m to 100 $\mu$m.

To ensure that the filler does not lead to a reinforcement of the polymer matrix, care should be taken that the filler particles adhere as little as possible to the polymer matrix. However, the adhesive forces between the particles and the filler matrix should at least be clearly less than the tensile strength of the matrix itself. Care will have to be taken, in particular, with the inorganic filler particles that these are essentially free from so-called coupling agents. Such coupling agents are customarily used in the production of filled plastics, in which emphasis is, however, placed on the particular strength of the material.

On the other hand, it is, of course, intended for the filler particles to be distributed as uniformly as possible in the plastic matrix and also retain this distribution during the production process and so supplementary agents are preferably added which improve the dispersibility of the filler particles in the matrix.

Low-melting organic substances, which have a large wetting ability for the filler, are particularly suitable as dispersing agents. Concrete examples are low-molecular polyolefin waxes.

The dispersing agents are preferably applied to the filler particles before these are mixed, in particular kneaded, with the granulate of the matrix plastic.

The thickness of the film is preferably selected to be from 20 $\mu$m to approximately 600 $\mu$m, which, on the one hand, ensures an adequate stability of the film for protecting the packed goods and, on the other hand, keeps the forces necessary for opening the packaging within the prescribed limit, within which at least goods insensitive to pressure can be removed by the average buyer, without problem, from the packaging by pushing through the cover film.

Particularly when packaging pharmaceuticals, it is often desirable for the film to be designed to be essentially impermeable to water and steam.

Polypropylenes are considered to be preferred polyolefins. The reason for this is to be seen in the particularly good physical properties of the polypropylene, such as, for example, blocking effect for steam, transparency etc.

The average molecular weight of the polymers in the plastic matrix is preferably selected to be in the range of approximately 10,000 to approximately 300,000.

In the films described thus far, solely the addition of fillers to the plastic matrix brought about an improved penetration resistance or resistance to further tearing thereof.

In larger packaging units, in which a plurality of articles are stored separately from one another on the product carrier and covered by the cover film, it is often desirable for the individual products to be removable from the product carrier separately from one another without the packaging of the individual products located adjacent thereto being damaged.

Depending on the nature of the lower part of the packaging, the normal sealing strength can already be adequate for solving the above-mentioned problem. However, if the sealing strength in a direct contact of the film with the lower part is too low, the necessity of an additional sealing layer on the film surface may result.

In the particularly preferred embodiment of the invention, the film is constructed of two or more layers, whereby the two or more layers of the film are preferably produced by co-extrusion.

For special purposes, it is possible for an external film layer to be designed as sealing layer. This can, on the one hand, serve to improve the adhesion of the cover film with the product carrier and can, on the other hand, be designed for specific uses with a special property, such as, for example, a special impermeability to steam, etc.

The invention relates furthermore to a packaging comprising a lower part as product carrier which is, where applicable, adapted in its shape to the products to be packed and an upper part consisting of an inventive film already described in the above.

In such a packaging, the lower part and the upper part are preferably produced using the same type of plastic so that a product made of the same type of materials is obtained. Such products are, in particular, easy to recycle and can be reused for the same purpose, which represents an optimum packaging cycle.

A particularly preferred use of the inventive packaging consists in the packaging of pharmaceuticals, which are present, in particular, in ampoule, capsule or tablet form.

The invention will now be explained in more detail in the following on the basis of one example:

In the first step, a polymer granulate is mixed with the filler proportions and subsequently extruded or calendered. The mixing, in particular the homogenizing, can take place by kneading in accordance with known processes, in particular, the twin-screw compounding. The individual components can, however, also be mixed with one another in a dry mixing process. A better homogeneity, i.e. a more uniform distribution of the fillers in the polymer matrix, is achieved by the preceding production of a so-called compound.

A treatment of the filler particles with dispersing agent should, in any case, take place prior to the mixing with the matrix plastic.

The compound is melted in the extruder, namely at melt temperatures of approximately 220° C. and more as well as at a melt pressure of up to 250 bar. The melt is preferably cooled over a chill roll at 20° C. to approximately 40° C. but other cooling processes, possibly combined with a surface treatment with a corona discharge, are also possible.

Afterwards the films are cut and wound.

When using polypropylene as polymer, a homopolymer polypropylene having a melt index of 2 to 10 g/10 min according to German Industrial Standard DIN 53735 (230° C./1.16 kg) and a density (23° C.) according to DIN 53479 of 0.900 to 0.910 g/cm$^3$ is mentioned as example. Different polypropylene types, such as, e.g., block copolymers or random copolymers, can, of course, also be used.

Chalk or talc is suggested as filler for this example, with an average particle size of 5 to 60 $\mu$m, better still with an average particle size of 20 to 30 $\mu$m. The proportion of fillers in the total film weight is preferably from 25 to 55% by weight. Below a filler proportion of 20% by weight, it is regularly no longer possible to obtain an adequate embrittlement of the plastic with the decrease in the penetration resistance and the resistance to further tearing linked thereto. With proportions clearly over 60% by weight, it is difficult to produce the films and the physical resistance values are then often no longer sufficient for the typical uses.

As is customary for the production of propylene films, a rewinding is also performed with the inventive film on a polypropylene basis for reasons of postcrystallization. (The period of time for postcrystallization is typically 4 to 10 days).

A film 150$\mu$m thick was produced with a mixture consisting of 50% by weight of polypropylene, homopolymer and 50% by weight of talc as filler, average particle size 20 $\mu$m.

A penetration resistance of 162N/mm and a resistance to further tearing of 3.2N could be measured on this film.

We claim:

1. A film for tamper-proof coverings for product carriers, the film comprising a single film layer or a laminate of film layers, at least one of said film layers comprising:

a plastic matrix, the plastic matrix comprising a polymer selected from the group consisting of polyolefins, polyesters, polystyrenes, polyvinylchloride and styrene copolymers;

a particulate filler incorporated within said plastic matrix, the particulate filler being present in an amount ranging from 20% to 60% by weight, said particulate filler having an average particle size ranging from approximately 5 μm to approximately 100 μm, as measured over the greatest extension of the particle;

said film having a penetration resistance, wherein said penetration resistance is below approximately 450N/mm as measured on a film having a thickness of 150 μm.

2. Film as defined in claim 1, characterized in that said particulate filler consists of an inorganic filler.

3. Film as defined in claim 1, characterized in that said film is two-layered or multi-layered.

4. Film as defined in claim 1, wherein at least a portion of said filler is an inorganic filler.

5. Film as defined in claim 1, characterized in that said film includes a sealing layer, wherein the penetration resistance of said film and said sealing layer is below approximately 450N/mm.

6. Packaging comprising a first part as product carrier adapted where applicable in its shape to the goods to be packed and a second part consisting of a film as defined in claim 5.

7. Packaging as defined in claim 6, characterized in that the first part and the second part are produced using the same plastic material.

8. Film as defined in claim 5, characterized in that the filler is chosen and the proportion of the filler selected such that the resistance to further tearing is reduced to below a limit of 30N.

9. Film as defined in claim 5, characterized in that the value of the penetration resistance is approximately 100 to approximately 200N/mm.

10. Film as defined in claim 8, characterized in that the value of the resistance to further tearing is approximately 3 to approximately 4N.

11. Film as defined in claim 5, characterized in that the particulate filler comprises inorganic and organic particles.

12. Film as defined in claim 11, characterized in that the organic component of the filler is selected from the group consisting of halogenated hydrocarbon polymers, polyether sulfones and thermoset plastics.

13. Film as defined in claim 12, wherein said filler is PTFE.

14. Film as defined in claim 5, characterized in that the inorganic particulate filler is selected from the group consisting of $SiO_2$, silicates, titanates, $TiO_2$, aluminum oxide, kaolin, calcium carbonates, magnesites, MgO, iron oxides, silicon carbides, silicone nitrides, and barium sulfate.

15. Film as defined in claim 14, wherein said filler is selected from the group consisting of glass and quartz.

16. Film as defined in claim 14, wherein said filler is talc.

17. Film as defined in claim 14, wherein said filler is chalk.

18. Film as defined in claim 5, characterized in that said penetration resistance is below approximately 200N/mm.

19. Film as defined in claim 5, characterized in that the filler is in the shape of granules, rods, plates, or fibers.

20. Film as defined in claim 5, characterized in that the filler content is approximately 25% by weight to approximately 55% by weight.

21. Film as defined in claim 5, characterized in that the filler particles are essentially free of coupling agents.

22. Film as defined in claim 5, characterized in that the filler particles are pretreated with a supplementary agent for improving the dispersibility of the filler particles in the matrix.

23. Film as defined in claim 5, characterized in that its thickness is approximately 20 μm to approximately 600 μm.

24. Film as defined in claim 5, characterized in that it is essentially impermeable to steam.

25. Film as defined in claim 24, characterized in that said plastic matrix includes a polypropylene.

26. A method of packaging a pharmaceutical, the method comprising placing the pharmaceutical within a package as defined in claim 6.

27. A covering film for tamper-proof coverings for product carriers, said covering film comprising a laminate of at least extruded first and second films, each of said first and second films comprising a plastic matrix, the plastic matrix comprising a polymer selected from the group consisting of polyolefins, polyesters, polystyrenes, polyvinylchloride and styrene copolymers;

at least one of said first and second films including a particulate filler incorporated within said plastic matrix, the particulate filler being present in an amount ranging from 20% to 60% by weight, said particulate filler having an average particle size ranging from approximately 5 μm to approximately 100 μm, as measured over the greatest extension of the particle;

said covering film having a penetration resistance, wherein said penetration resistance is below approximately 450N/mm as measured on a film having a thickness of 150 μm.

28. Film as defined in claim 27, characterized in that said film is two-layered.

29. Film as defined in claim 27, characterized in that said penetration resistance is below approximately 200N/mm.

30. Covering film according to claim 27, wherein at least a portion of said filler is an inorganic filler.

* * * * *

UNITED STATES PATENT AND TRADEMARK OFFICE

CERTIFICATE OF CORRECTION

PATENT NO. : 5,932,338
DATED : August 3, 1999
INVENTOR(S) : Schnäbele et al.

It is certified that error appears in the above-identified patent and that said Letters Patent is hereby corrected as shown below:

ON THE TITLE PAGE:

Under [75] Inventors: "Schnabele" should read --Schnäbele--.
"Lubemann" should read --Lüdemann--.
"Wolfsbanger" should read --Wolfsberger--.

Under [57] Abstract

Line 2: "platic" should read --plastic--.
"suggersted" should read --suggested--.

IN THE CLAIMS:

In Claim 14, Column 5, Line 50: "silicone" should read -- silicon--.

Signed and Sealed this

Twenty-eighth Day of March, 2000

*Attest:*

*Attesting Officer*

Q. TODD DICKINSON

*Commissioner of Patents and Trademarks*

UNITED STATES PATENT AND TRADEMARK OFFICE

CERTIFICATE OF CORRECTION

PATENT NO. : 5,932,338
DATED : Aug. 3, 1999
INVENTOR(S) : Schnabele et al

It is certified that error appears in the above-identified patent and that said Letters Patent is hereby corrected as shown below:

On the title page,

Under [73] Assignees: "Plastec" should read --PlasTec--.

"Gesellshaft" should read -- Gesellschaft m.b.H.--.
"Mannsworth" should read --Mannswörth--.

Signed and Sealed this

Sixteenth Day of May, 2000

*Attest:*

Q. TODD DICKINSON

*Attesting Officer*

*Director of Patents and Trademarks*